United States Patent [19]

Rumble

[11] Patent Number: 4,518,212

[45] Date of Patent: May 21, 1985

[54] MULTIPLE PIN ELECTRICAL PLUG

[75] Inventor: Clive S. Rumble, London, England

[73] Assignee: Corabelment A.G., Vaduz, Liechtenstein

[21] Appl. No.: 407,571

[22] Filed: Aug. 12, 1982

[51] Int. Cl.[3] ..... H01R 27/00

[52] U.S. Cl. ..... 339/31 R; 339/32 R; 339/36

[58] Field of Search ..... 339/31 R, 31 M, 32 R, 339/32 M, 33, 36, 75 P

[56] References Cited

U.S. PATENT DOCUMENTS

| | | | |
|---|---|---|---|
| 2,417,928 | 3/1947 | Guernsey | 339/31 M |
| 2,946,037 | 7/1960 | Platz et al. | 339/36 |
| 2,989,719 | 6/1961 | Aarlaht | 339/31 R |
| 4,113,333 | 9/1978 | Horowitz | 339/75 P |
| 4,249,813 | 2/1981 | Nihei | 339/33 |
| 4,279,457 | 7/1981 | Nickence | 339/36 |

FOREIGN PATENT DOCUMENTS

| | | | |
|---|---|---|---|
| 0048078 | 3/1982 | European Pat. Off. . | |
| 2414203 | 10/1975 | Fed. Rep. of Germany . | |
| 7807806 | 1/1979 | Fed. Rep. of Germany . | |
| 1220025 | 4/1962 | France | 339/32 M |
| 516191 | 2/1955 | Italy | 339/32 M |
| 28607 | 7/1932 | Netherlands | 339/36 |

*Primary Examiner*—John McQuade
*Assistant Examiner*—Thomas Kline
*Attorney, Agent, or Firm*—Stevens, Davis, Miller & Mosher

[57] ABSTRACT

A multiple pin electrical plug having a variety of pin combinations of varying geometry is able to accept the several voltage outlet supplies of the major countries of the world. The multiple pin electrical plug is so arranged that pins (P1 to P7 inclusive) are able to extend in a number of configurations dictated by the movement of a shutter plate (21) having a slider (22) that is movable to at least the same number of discrete positions, as said number of configurations.

2 Claims, 7 Drawing Figures

MULTIPLE PIN ELECTRICAL PLUG

This invention relates to a multiple pin electrical plug. Such a plug has a variety of pin combinations of varying geometry, able to accept the several voltage outlet supplies of the major countries of the world.

According to the present invention there is provided a multiple pin electrical plug from which pins are able to extend in a number of configurations dictated by the movement of a shutter plate having a slider that is movable to at least the same number of discrete positions, as said number of configurations.

In one multiple pin electrical plug a pin slide is arranged to co-operate with the shutter plate to an extend, or retract, position and to an extend but non-retractable position.

Figure 1A:
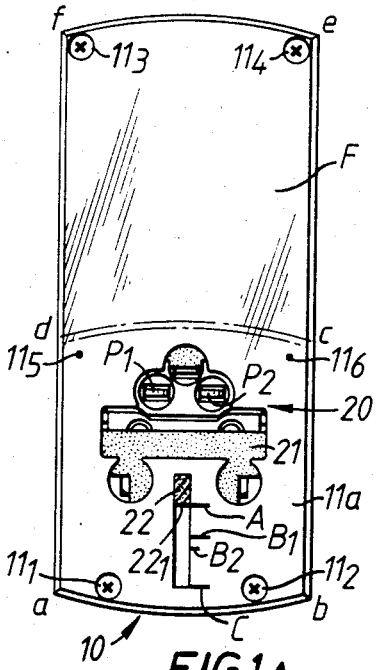
Figure 1B:
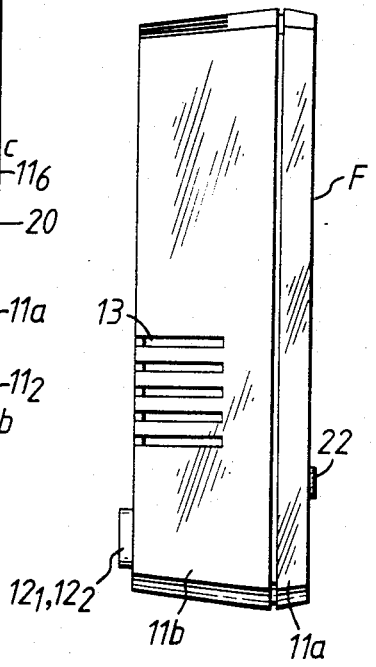
Figure 1C:
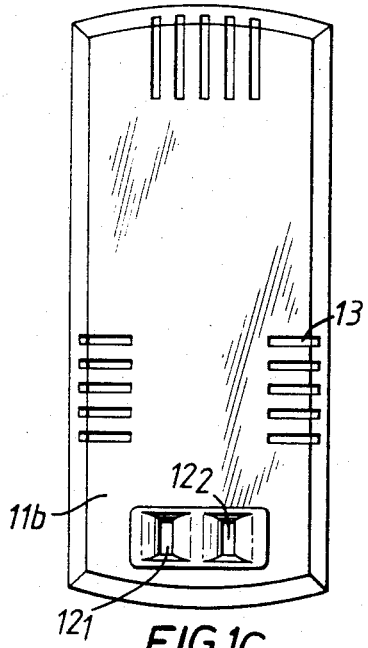
Figure 21:
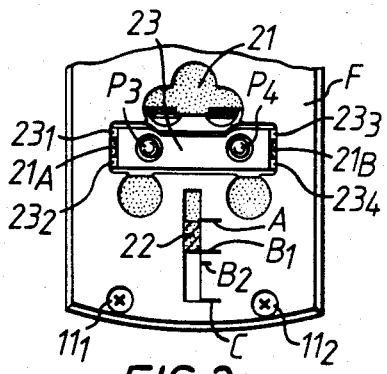

The invention will be more fully understood from the following description given by way of example only with reference to the several figures of the accompanying drawings in which:

FIGS. 1A, 1B, 1C are presented in third angle orthographic projection. FIG 1A shows an inlet voltage face of a multiple plug, FIG. 1B a side elevation and FIG. 1C an outlet voltage face.

FIG. $2_1$ shows the inlet face of FIG. 1A with an alternative inlet configuration different from that of FIG. 1 but in an intermediary condition.

FIG. $2_{1A}$ shows to an enlarged scale in oblique perspective the configuration of FIG. $2_1$.

FIG. $2_{1B}$ also in oblique perspective shows the pin configuration in its final form for one of the electrical usages.

Figure 3:
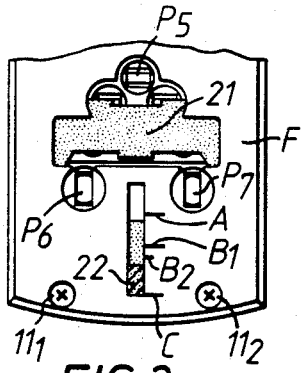
Figure 21A:
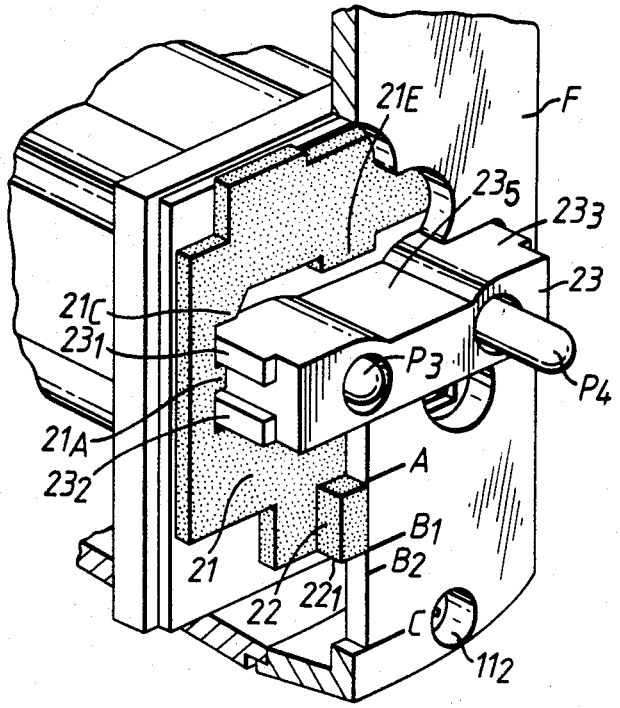
Figure 21B:
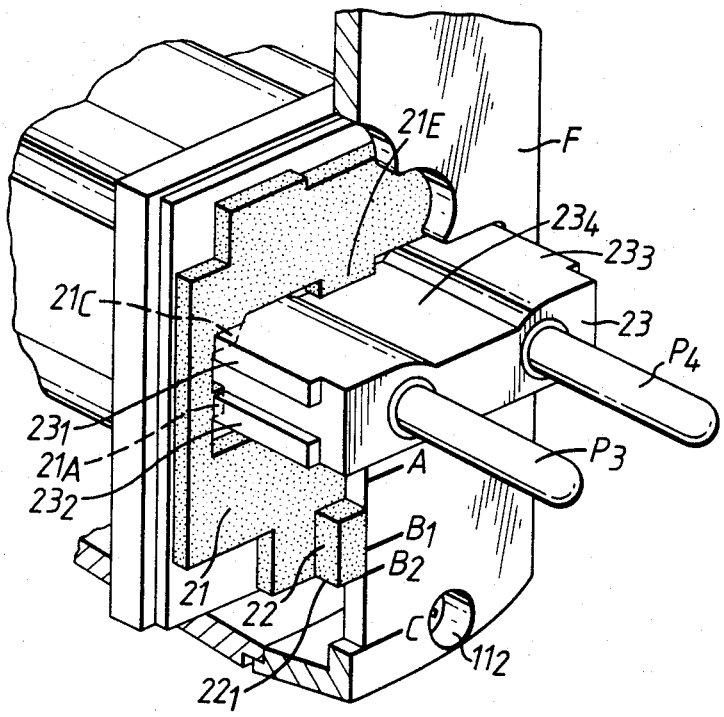

FIG. 3 is another alternative inlet configuration shown in a form similar to that of FIGS. 1 and 2.

Referring now specifically to the figures. In FIGS. 1A, 1B, 1C a unitary plug shown generally at 10 has either an inlet face F of area abcd or abef depending on whether ancillary electrical means is to be combined with the plug (see our co-pending United Kingdom application No. 8201337). The unitary plug for convenience only is shown with a two part case 11*a*, 11*b* of inlet area a b e f held together by screws $11_1$ and $11_4$. The case has outlet sockets $12_1$ $12_2$ and vent louvers 13. (In the smaller plug abcd two screws $11_5$, $11_6$ will be inserted or sealed by other means).

Consider now the multiple pin plug shown generally at 20 (FIG. 1A). A movable shutter plate 21 has an integral slider 22 accessible to the hand of the operator, the edge $22_1$ of the slider may be brought into alignment with index marks on the inlet face such as marks A, $B_1$, $B_2$ and C to give four separate pin geometries.

In FIG. 1A the edge $22_1$ is against index mark A and the flat pin pair P1, P2 may be withdrawn and oriented (turned through an angle) where they are held in correct orientation for use in accepting the electrical voltage outlets of United States of America and Australasia for example. This is a first pin geometry.

Consider now the position shown in FIG. $2_1$. The edge $22_1$ of slider 22 is agaist index mark B1 and the pin pair, P3 P4 may be each withdrawn and rotated on their individual pin axes to engage a locking structure whereby they are locked and the pins used in this position. This is a second pin geometry.

Consider now the position shown in FIGS. $2_1$, and $2_{1A}$. The edge $22_1$ of slider 22 is again at index mark $B_1$ FIGS. $2_1$, $2_{1A}$) and slider plate 21 allows pin-slide 23 of general rectangular prismatic form to be withdrawn out of inlet face F and to be functionally positioned for use. The pin-slide 23 has integral side rails $23_1$, $23_2$, $23_3$, $23_4$ that coact with opposed plate protuberances 21A, 21B (FIG. $2_1$). With the pin-slide 23 extended (FIG. $2_{1B}$) the right cylindrical pin-pair P3, P4 is locked by rotation of each pin individually as described above and the shutter plate 21 moved so that edge $22_1$is in alignment with index mark $B_2$ (FIG. $2_{1B}$). This brings opposed plate protuberances 21A, 21B, 21C and another one (hidden and thus not shown) respectively behind the pin slide rails $23_2$, $23_4$, $23_1$, $23_3$. This is shown for co-operating parts $21_A$, $23_2$, $21_C$ and $23_1$ in FIG. $2_{1B}$ (co-operating parts $21_B$, $23_4$, $21_D$ and $23_3$ are not visible). The shutter plate 21 is provided with a protuberance 21E (well seen in FIG. $2_{1B}$) that with the plate on index B2 brings the edge of protuberance 21E against face $23_5$ of pin-slide 23 and gives to it an enhanced stability in electrical usage. Clearly at index mark position B2, pin-pair P3, P4 in pin-slide 23 cannot be retracted to re-enter the plug until protuberances 21A, 21B, 21C, and the hidden one are again raised for edge $22_1$ to come on to index mark B1 when the pin-slide 23 is retractable.

The pin-pair P3, P4 with pin slide 23 extended as shown in FIG. $2_{1B}$ is for use with the recessed electrical voltage outlet sockets to be found in Germany, Belgium and other parts of Europe, for example such as the Schuko socket. In some such sockets an earth pin from the socket can enter the plug inlet over surface $23_5$. This is a third pin geometry.

In FIG. 3 the shutter plate 21 is with edge $22_1$ at indes C and the three heavy rectangular section pins P5, P6, P7 can come out beyond the inlet face F and cooperate with a locking structure whereby each can be rotated through a right angle to lock the pin. These pins are for use with the voltage outlets to be found inter alia in the United Kingdom, pin P5 being an earth pin oriented one right angle out of alignment with live and neutral pins P6, P7. This is a fourth pin geometry.

I claim:

1. A multiple pin electrical plug for selectively providing electrical pins in different configurations corresponding to different electrical sockets, comprising:

a plurality of selectively extendable pins;

a shutter plate movable by a hand operated slider between a plurality of discrete positions for selecting one of said different configurations and permitting extension of predetermined ones of said pins, at least one pair of said pins being provided on a prismatic sliding member, said sliding member having guide rails said shutter plate having protuberances co-operating with said guide rails to permit said sliding member to be extended from or retracted into said plug when said shutter plate is in one of said discrete positions and to permit movement of said shutter plate into another discrete position, preventing retracting of said sliding member, when the latter is extended.

2. A multiple pin electrical plug as in claim 1, wherein said shutter plate selects among four different pin configurations, a first in which said plug provides an extended flat pin pair, a second in which said plug provides an extendable and retractable cylindrical pin pair, a third in which said plug provides an extended and not retractable cylindrical pin pair, and a fourth in which said plug provides three extended flat pins.

* * * * *